US008864280B2

(12) United States Patent
Van Brocklin

(10) Patent No.: US 8,864,280 B2
(45) Date of Patent: Oct. 21, 2014

(54) SWITCHABLE FEEDBACK DAMPING OF DROP-ON-DEMAND PIEZOELECTRIC FLUID-EJECTION MECHANISM

(75) Inventor: Andrew L. Van Brocklin, Corvallis, OR (US)

(73) Assignee: Hewlett-Packard Development Company, Houston, TX (US)

( * ) Notice: Subject to any disclaimer, the term of this patent is extended or adjusted under 35 U.S.C. 154(b) by 71 days.

(21) Appl. No.: 13/696,974

(22) PCT Filed: May 14, 2010

(86) PCT No.: PCT/US2010/035017
§ 371 (c)(1),
(2), (4) Date: Nov. 8, 2012

(87) PCT Pub. No.: WO2011/142766
PCT Pub. Date: Nov. 17, 2011

(65) Prior Publication Data

US 2013/0057610 A1 Mar. 7, 2013

(51) Int. Cl.
*B41J 29/393* (2006.01)
*B41J 2/045* (2006.01)

(52) U.S. Cl.
CPC ..... *B41J 2/04581* (2013.01); *B41J 2/04541* (2013.01)
USPC ..... 347/19; 347/14; 347/10

(58) Field of Classification Search
USPC ..... 347/14, 19, 10
See application file for complete search history.

(56) References Cited

U.S. PATENT DOCUMENTS

| | | | | |
|---|---|---|---|---|
| 4,498,089 | A | 2/1985 | Scardovi | |
| 4,535,346 | A | 8/1985 | Lichti | |
| 5,384,583 | A | 1/1995 | Katerberg et al. | |
| 5,426,455 | A | 6/1995 | Williamson et al. | |
| 5,757,392 | A * | 5/1998 | Zhang | 347/14 |
| 6,068,360 | A | 5/2000 | Hiwada | |
| 6,186,610 | B1 | 2/2001 | Kocher et al. | |
| 6,286,922 | B1 | 9/2001 | Kondou | |
| 6,371,587 | B1 | 4/2002 | Chang | |
| 6,443,547 | B1 | 9/2002 | Takahashi et al. | |

(Continued)

FOREIGN PATENT DOCUMENTS

JP 2006255975 9/2006

OTHER PUBLICATIONS

H. Wijshoff, "Manipulating drop formation in piezo acoustic inkjet," Procs. IS&T's NIP22, 79 (year 2006).

(Continued)

*Primary Examiner* — Julian Huffman

(57) ABSTRACT

A control circuit for a drop-on-demand piezoelectric fluid-ejection mechanism includes a drive and sense circuit, and a switch. The drive and sense circuit has an input, a drive output, and a sense output. The drive output is to be coupled to the drop-on-demand piezoelectric fluid-ejection mechanism. The switch is to switch the input of the drive and sense circuit between a feed-forward driving mode of the drive and sense circuit and a feedback damping mode of the drive and sense circuit. In the feed-forward driving mode, the switch is to couple the input to a drive waveform to cause the fluid-ejection mechanism to eject a drop of fluid. In the feedback damping mode, the switch is to couple the input to the sense output to dampen the fluid-ejection mechanism after the fluid-ejection mechanism has ejected the drop of fluid.

13 Claims, 4 Drawing Sheets

(56) References Cited

U.S. PATENT DOCUMENTS

| | | | |
|---|---|---|---|
| 6,465,933 | B1 | 10/2002 | North, Jr. |
| 6,830,302 | B2 | 12/2004 | Masumoto et al. |
| 6,929,340 | B2 | 8/2005 | Ishizaki |
| 7,439,659 | B2 | 10/2008 | Tsukamoto |
| 2007/0279446 | A1 | 12/2007 | Ishizaki |
| 2009/0085435 | A1 | 4/2009 | Sekiguchi |
| 2009/0085988 | A1 | 4/2009 | Sekiguchi |
| 2009/0115821 | A1 | 5/2009 | Tsukamoto |

OTHER PUBLICATIONS

J.J. Dosch et al., "A self-sensing piezoelectric actuator for collocated control," J'l of Intell Mat'l Sys. & Struct., vol. 3, Jan. 1992.

M.B. Groot Wassink, "Inkjet printhead performance enhancement by feedforward input design based on two-port modeling," Thesis, Dutch Institute of Systems and Control (DISC), ISBN 978-90-9021484-9, copyright 2007.

* cited by examiner

DRIVE
OUTPUT 108
INPUT
106
402
410
404
SENSE
OUTPUT
107
210
412
102
SENSING
CAPACITOR
208

INPUT
106
506
102
502
504
DRIVE
OUTPUT 108
210
SENSING
CAPACITOR
208
508
SENSE
OUTPUT 107

SWITCHABLE FEEDBACK DAMPING OF DROP-ON-DEMAND PIEZOELECTRIC FLUID-EJECTION MECHANISM

BACKGROUND

Drop-on-demand fluid-ejection devices are employed to selectively eject drops of fluid. For example, inkjet printing devices selectively eject drops of ink on demand onto media like paper to form images on the media. One type of drop-on-demand fluid-ejection device is a drop-on-demand piezoelectric fluid-ejection device. In a piezoelectric fluid-ejection device, the piezoelectric effect is used to eject droplets of fluid. In particular, an electric field is induced within a flexible sheet of piezoelectric material to cause the sheet to physically deform. Physical deformation of the sheet results in a drop of fluid being ejected.

DETAILED DESCRIPTION

Figure 1:
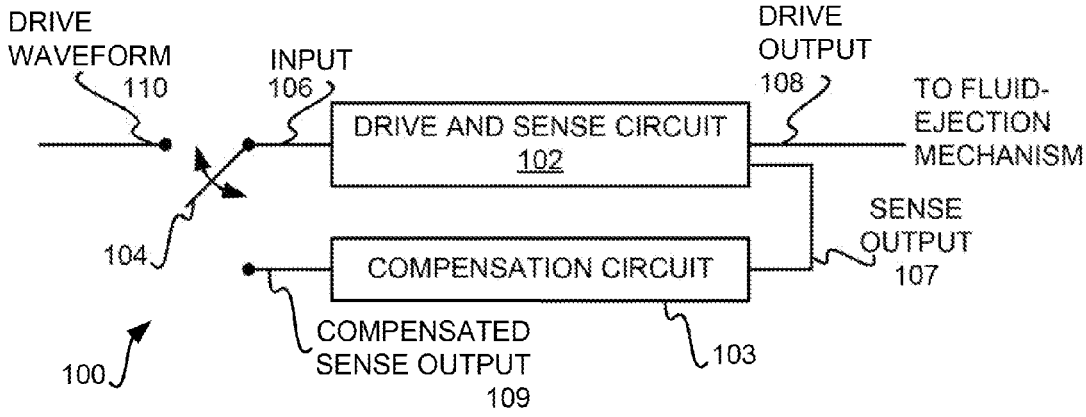
FIG. 1 is a diagram of an example control circuit for a drop-on-demand piezoelectric fluid-ejection mechanism.

As noted in the background section, in a drop-on-demand piezoelectric fluid-ejection device, an electric field is induced within a flexible sheet of piezoelectric material to cause the sheet to physically deform, which results in a drop of fluid being ejected. Resonance assists in the ejection of a fluid drop from such a fluid-ejection device. More specifically, one or more resonant frequencies of the sheet of piezoelectric material and the fluid-mechanical system to which it is attached can be leveraged to increase the size and/or linear velocity of the fluid drop ejected from the fluid-ejection device. By perturbing the sheet and/or the fluid-mechanical system at a chosen resonant frequency, larger fluid drops and/or higher linear velocity ejection of the fluid drops can be achieved.

However, after the piezoelectric fluid-ejection device has ejected a fluid drop, it is desirable to stop the mechanical motion resulting from the resonant frequencies of the system. Otherwise, such resonance can interfere with the ejection of the next fluid drop from the fluid-ejection device. The fluid-ejection device is fired under the assumption that the sheet of piezoelectric material and the fluid are at rest, and are not currently resonating at a level that interferes with the drops to be ejected. If either or both of the sheet and the fluid are still resonating when the fluid-ejection device is fired, the resulting fluid drop may be ejected in an unpredictable way. For example, the fluid drop may be larger than desired, and/or may be ejected more quickly than desired. This can cause undesirable and often readily apparent print quality issues in fluid-ejection devices specifically designed to print human-viewable marks, such as images and/or text, on media like paper.

To reduce the motion resulting from such mechanical resonance after a fluid drop has been ejected from a piezoelectric fluid-ejection device, typically what is referred to as a tickle pulse is applied. A tickle pulse is a short pulse of typically lower amplitude than the pulse or pulses that resulted in ejection of the fluid drop from the fluid-ejection device. The purpose of the tickle pulse is to jar the sheet of piezoelectric material and the fluid in the opposite direction of motion from that of the resonance, without ejecting a fluid drop from the fluid-ejection device. As such, energy is removed from the piezoelectric fluid-ejection device to dampen the motion of the device. However, a tickle pulse may not completely stop the sheet and the fluid from resonating. This is because there can be limitations to the waveform of the pulse, and because the amplitude and phase of the excited resonance may be difficult to predict due to manufacturing variations as well as variable electrical and mechanical stimuli.

In an example, rather than a tickle pulse, feedback damping is employed to dampen the resonance of the sheet of piezoelectric material and the fluid within a piezoelectric fluid-ejection device. An input of a drive and sense circuit is initially coupled to a drive waveform that corresponds to the fluid drop to be ejected from the fluid-ejection device. The drive and sense circuit operates in a feed-forward (i.e., no feedback) driving mode to amplify the drive waveform directly so that the fluid drop is properly ejected from the fluid-ejection device.

Once the fluid drop has been ejected, the input of the drive and sense circuit is coupled to the output of the drive and sense circuit through a compensation circuit, to dampen resonance in a feedback damping mode of the drive and sense circuit in preparation for the next fluid drop to be ejected from the piezoelectric fluid-ejection device. By feeding back the output of the drive and sense circuit through the compensation circuit to the input of the drive and sense circuit, the resonance of the sheet of piezoelectric material and/or the fluid is dampened with a waveform that is optimal to dampen the resonance. The resonance is thus reduced more completely than when using a tickle pulse, and sometimes in a shorter period of time.

FIG. 1 shows a control circuit 100 for a drop-on-demand piezoelectric fluid-ejection mechanism, according to an example. The fluid-ejection mechanism includes one or more fluid-ejection nozzles through which drops of fluid are ejectable. The fluid-ejection mechanism can be a part of a fluid-ejection printhead, may include one or more fluid-ejection printheads, or may be a fluid-ejection printhead.

The control circuit 100 includes a drive and sense circuit 102, a compensation circuit 103, and a switch 104. The drive and sense circuit 102 includes an input 106, a sense output 107, and a drive output 108. The switch 104 switches the input 106 between a drive waveform 110 and a compensated sense output 109 of the compensation circuit 103. The drive output 108 is coupled to the piezoelectric fluid-ejection mechanism. In one example, the compensation circuit 103 may be a low-pass filter to select the resonance modes to be dampened by removing high-frequency components of the signal at the drive output 108, and to assure phase and/or gain margin in the feedback loop. In another example, the compensation circuit 103 may include a network having a feedback integrator and a summing function integrator.

To cause the piezoelectric fluid-ejection mechanism to eject a drop of fluid, the switch 104 switches the input 106 so that it is coupled to the drive waveform 110. When the input 106 is coupled to the drive waveform 110, the drive and sense circuit 102 is operating in a feed-forward driving mode. The drive waveform 110 at the input 106 is amplified by the drive and sense circuit 102, and the amplified drive waveform 110 is provided at the drive output 108 to the fluid-ejection mechanism. The drive waveform 110 corresponds to the desired drive waveform to cause a fluid drop to be ejected by the fluid-ejection mechanism. The drive and sense circuit 102 permits the drive waveform to be of lower voltage and power than that which causes the fluid-ejection mechanism to eject a drop of fluid. In the feed-forward driving mode, the compensated sense output 109 of the compensation circuit 103 does not feed back to the input 106 of the drive and sense circuit 102.

Once the fluid drop has been ejected by the piezoelectric fluid-ejection mechanism, the switch 104 switches the input 106 so that it is coupled to the compensated sense output 109. When the input 106 is coupled to the compensated sense output 109, the drive and sense circuit is operating in a feedback damping mode. The remaining movement of the fluid-ejection mechanism due to resonance is sensed by the drive and sense circuit 102, and a resonance damping waveform that is opposite in amplitude to this resonance is output at the drive output 108 of the drive and sense circuit 102. As such, the resonance of the fluid-ejection mechanism is quickly dampened to the point where the fluid-ejection mechanism is no longer resonating at a level that will noticeably affect the timing or directionality of the next ejected fluid drop. At this time, then, the switch 104 can switch the input 106 back to the drive waveform 110, so that the next fluid drop can be ejected from the fluid-ejection mechanism.

The drive and sense circuit 102 is thus a drive circuit in that the signal at its drive output 108 is used to drive the fluid-ejection mechanism to cause the fluid-ejection mechanism to outlet a fluid drop in a feed-forward driving mode. The drive and sense circuit 102 is a sense circuit in that the signal at its sense output 107 is used to provide a signal at its drive output 108 to dampen resonance within the fluid-ejection mechanism in a feedback damping mode. That is, the drive and sense circuit 102 is a sense circuit in that the signal at its sense output 107 reflects the sensed resonance within the fluid-ejection mechanism. Furthermore, the compensation circuit 103 is a compensation circuit in that the signal at its compensated sense output 109 compensates, or modifies, the signal at the sense output 107 of the drive and sense circuit 102 so that desired damping of the fluid-ejection mechanism occurs.

Figure 2:
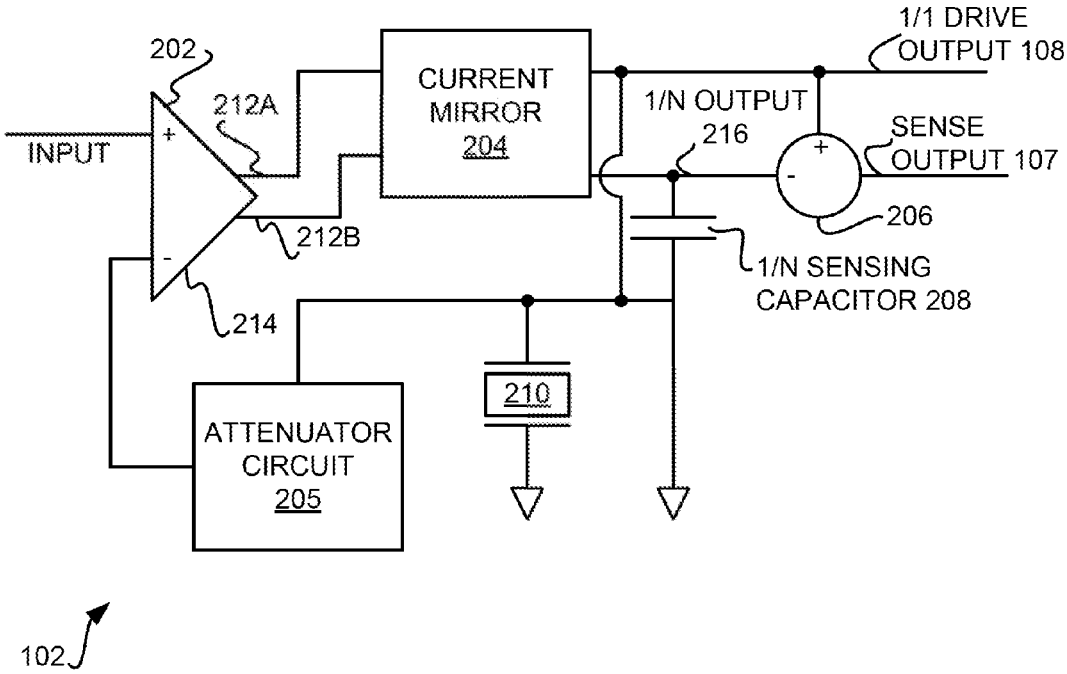
FIG. 2 is a diagram of an example drive and sense circuit of the control circuit of FIG. 1 in detail.

FIG. 2 shows the drive and sense circuit 102 in detail, according to an example of the disclosure. The drive and sense circuit 102 includes an amplifier 202, a current mirror 204, an attenuator 205, a summing device 206, and a sensing capacitor 208. The capacitance of the piezoelectric fluid-ejection mechanism is represented as the capacitance 210 in FIG. 2. It is noted that the drive and sense circuit 102 does not include any resistors, and thus is resistorless. This is advantageous, as resistors can result in increased power consumption within electrical circuits. Furthermore, the drive and sense circuit 102 of FIG. 2 includes just one capacitor 208, which is scaled to 1/N, where N is the ratio used in the current mirror 204 as described below. This is advantageous as well, because capacitances similar in magnitude to that of a piezoelectric actuator are relatively expensive to fabricate on integrated circuits, as compared to transistors and small value resistors.

The positive input of the amplifier 202 is the input 106 of the drive and sense circuit 102, whereas the negative input of the amplifier 202 is connected to the drive output 108 of the current mirror 204 through the attenuator 205 that determines the gain of the amplifier 202. The outputs 212A and 212B of the amplifier 202, which are collectively referred to as the outputs 212, are connected to the current mirror 204. The outputs 212 are complementary to one another, and are suitably biased to form a final output stage using transistors within the current mirror 204.

The drive output 108 of the current mirror 204 is a 1/1 output. That is, the drive output has a current equal to the current at the outputs 212 of the amplifier 202. The current mirror 204 also has a 1/N output 216, which is the current at the outputs 212 of the amplifier 202 divided by N, where N is the ratio of the current mirror 204, in that the current mirror 204 mirrors the current at its inputs by a factor of 1/N. N is greater than one, and in one example N may be twenty. The drive output 108 is connected to the positive input of the summing device 206, whereas the 1/N output 216 is connected to the negative input of the summing device 206. The sensing capacitor 208 is connected between the 1/N output 216 of the current mirror 204 and a common voltage, such as ground. Similarly, the capacitance 210 of the fluid-ejection mechanism is connected between the drive output 108 and the common voltage. The output of the summing device 206 is the sense output 107 of the drive and sense circuit 102.

The amplifier 202 can be an operational amplifier. For example, the amplifier 202 may be a conventional folded cascode operational amplifier having a folded cascode amplification stage, an amplification class A-B output stage, and a final output stage in one example. As such, the amplifier 202 can be implemented exclusively with transistors. The summing device 206 can also be implemented with an operational amplifier, and as such can be implemented exclusively with transistors. The amplifier 202 amplifies the voltage differential between its positive and negative inputs.

The attenuator 205 is in the feedback loop of the amplifier 202 and determines the gain from the input 106 to the drive output 108. This is achieved by the attenuator 205 attenuating the signal at the drive output 108. In one example, the attenuator 205 may be implemented by using a capacitive divider, a switched capacitor, or a resistor-divider circuit.

By effectively reducing the current from the outputs 212 of the amplifier 202 to the 1/N output 216, the current mirror 204 permits the sensing capacitor 208 to have a smaller capacitance, and thus occupy less physical space when implemented on a circuit board and be less expensive to fabricate, than if the current mirror 204 were not present. That is, if the current at the output 214 of the amplifier 202 were not reduced by the current mirror 204, the sensing capacitor 208 would have to have a larger capacitance, occupy more physical space when implemented on an integrated circuit, and be more expensive to fabricate. Therefore, the utilization of the current mirror 204 in FIG. 2 is advantageous.

The summing device 206 amplifies the voltage difference at its positive and negative inputs. The voltage at the negative input of the summing device 206 is the voltage over the sensing capacitor 208. By comparison, the voltage at the positive input of the summing device 206 is the voltage over the capacitance 210 of the piezoelectric fluid-ejection mechanism itself. The output of the summing device 206 is the sense output 107 of the drive and sense circuit 102. The current mirror 204 generates the drive output 108, and thus serves to drive the fluid-ejection mechanism to either cause the mechanism to eject a drop of fluid in the feed-forward driving mode or to be dampened in the feedback damping mode.

In the feed-forward driving mode, the sense output 107 is not fed back to the input 106 of the drive and sense circuit 102 through the compensation circuit 103 of FIG. 1, but rather a drive waveform is applied at the input 106. The drive waveform is amplified by the amplifier 202 and the current mirror 204 to cause the piezoelectric fluid-ejection mechanism at the drive output 108 of the drive and sense circuit 102 to eject a drop of fluid. By comparison, in the feedback damping mode, the drive output 108 is fed back to the input 106 of the drive and sense circuit 102 through the compensation circuit 103 of FIG. 1. The voltage over the capacitance 210 of the fluid-ejection mechanism is compared to the voltage over the capacitance of the sensing capacitor 208 to generate a signal at the drive output 108 that is proportional and opposite to the resonance of the fluid-ejection mechanism. As such, this resonance is dampened.

It is noted that the summing device 206 effectively compares the voltage over the capacitance 210 of the piezoelectric fluid-ejection mechanism with the voltage over the capacitance of the sensing capacitor 208. This is because the latter voltage is subtracted from the former voltage by the summing device 206. The result of this comparison is the sense output 107.

Figure 3:
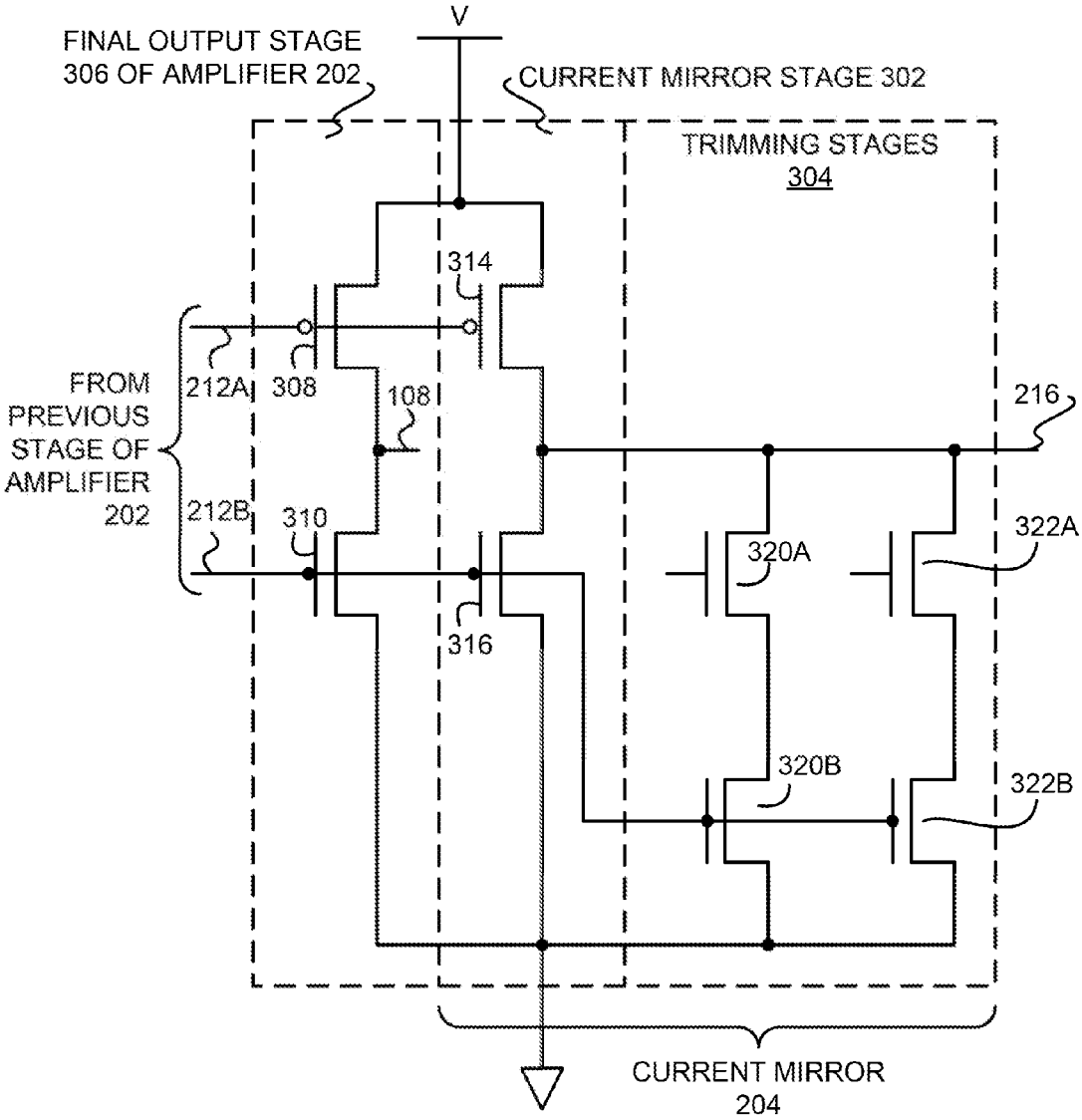
FIG. 3 is a diagram of an example current mirror of the drive and sense circuit of FIG. 2 in detail.

FIG. 3 shows the current mirror 204 in detail, according to an example. The current mirror 204 is specifically adapted to the case where the amplifier 202 is a conventional folded cascode operational amplifier. In FIG. 3, the final output stage 306 of the amplifier 202 is conventional, and is depicted just to clarify how the current mirror 204 is connected to the amplifier 202. The other stages of the amplifier 202, such as the folded cascode amplification stage and other portions of the class A-B output stage, are also conventional, and are not depicted in FIG. 3.

The final output stage 306 of the amplifier 202 includes two transistors 308 and 310 connected in series between a voltage V and a common voltage such as ground. The gates of the transistors 308 and 310 are connected to a previous stage of the amplifier 202, and are suitably biased to function as a conventional final output pair. The gate of the transistor 308 is connected in an inverted manner to an output 212A of the amplifier 202, whereas the gate of the transistor 310 is connected in a non-inverted manner to an output 212B of the amplifier 202, where the outputs 212A and 212B make up the outputs 212 of the amplifier 202 depicted in FIG. 2. The output of the final output stage 306 is the drive output 108 of the amplifier 202.

The current mirror 204 includes a current mirror stage 302. The current mirror stage 302 is the stage of the current mirror 204 that effectively reduces the current at the output 216 to a ratio of the current at the output 108. In particular, the current mirror 204 includes two transistors 314 and 316 that are connected in series between the voltage V and the common voltage. As with the transistors 308 and 310, the gates of the transistors 314 and 316 of the current mirror 204 are connected to a previous stage of the amplifier 202. The gate of the transistor 314 is connected in an inverted manner to an output 212A of the amplifier 202, whereas the gate of the transistor 316 is connected in a non-inverted manner to an output 212B of the amplifier 202. The output 216 of the current mirror stage 302 is the output of the current mirror 204 that is connected to the sensing capacitor 208 and the negative input of the summing device 206 in FIG. 2.

The transistors 314 and 316 of the current mirror stage 302 are sized or otherwise specified in relation to the transistors 308 and 310 of the final output stage 306 of the amplifier 202 so that the current at the output 216 is equal to the current at the output 214 of the amplifier 202 by a 1/N (i.e., one-to-N) ratio. As noted above, N is greater than one, and may be twenty in one example. In this way, the current mirror stage 302 effectively reduces the current at the output 214 of the amplifier 202, by providing a current at its output 216 that is equal to the current at the output 214 by a 1/N ratio.

In one example, the current mirror 204 also includes one or more trimming stages 304. The trimming stages 304 are present to further trim, or adjust, the current at the output 216 of the current mirror 204. When the drive and sense circuit 102 as a whole is not actively being driven by the drive waveform 110 in the feed-forward driving mode and is not dampening the piezoelectric fluid-ejection mechanism in the feedback damping mode—that is, when no signal is being applied to the input 106 of the drive and sense circuit 102—a remaining current may nevertheless be present at the output 216. This is due to a potential mismatch introduced by conventional semiconductor transistor fabrication. To obviate any undue effects from this current, the trimming stages 304 may be switched on to reduce the current at the output 216 further, to as close to zero as desired. As such, the stages 306 and 302 can match a specified current offset as closely as desired.

In FIG. 3, two trimming stages 304 are shown: a first trimming stage made up of transistors 320A and 320A, collectively referred to as the transistors 320; and a second trimming stage made up of transistors 322A and 322B, collectively referred to as the transistors 322. However, in other examples, there may be more or fewer trimming stages 304. The transistors 320 of the first trimming stage are connected in series between the output 216 and the common voltage, and likewise the transistors 322 of the second trimming stage are connected in series between the output 216 and the common voltage. The transistors 320A and 322A are independently turned on by selectively applying voltages at their gates. By comparison, the gates of the transistors 320B and 322B are connected to the output 212B of the amplifier 202.

To turn on the first trimming stage made up of the transistors 320, a voltage is applied at the gate of the transistor 320A. Likewise, to turn on the second trimming stage made up of the transistors 322, a voltage is applied at the gate of the transistor 322A. The gates of the transistors 320A and 322A can have voltages applied thereat independently and in a selective manner. As such, just the first trimming stage may be turned on, just the second trimming stage may be turned on, or both the first and second trimming stages may be turned on.

The transistors 320 are sized or otherwise specified in relation to the transistors 314 and 316 to reduce the current at the output 216 by a desired first amount, and the transistors 322 are likewise sized or otherwise specified in relation to the transistors 314 and 316 to reduce the current at the output 216 by a desired second amount. The ratio of the transistor 314 to the transistor 308 is decreased by half of the trim amount to allow for the trimming stages 304 to compensate both positively and negatively. For example, if the trimming is for +/−0.75%, then the transistor 314 is increased in size by 0.75%, so that turning the transistors 320A and 322B off yields a trim value of +0.75% current. As such, the first trimming stage may reduce the current at the output 216 by 1.00% and the second trimming stage may reduce the current at the output 216 by 0.50%. When both trimming stages are turned on, the overall reduction in the current at the output 216 is thus +0.75% −1.00% −0.50%, or −0.75%. More trimming stages can be added to the trimming stages 304 to trim the current as closely as desired.

Figure 4:
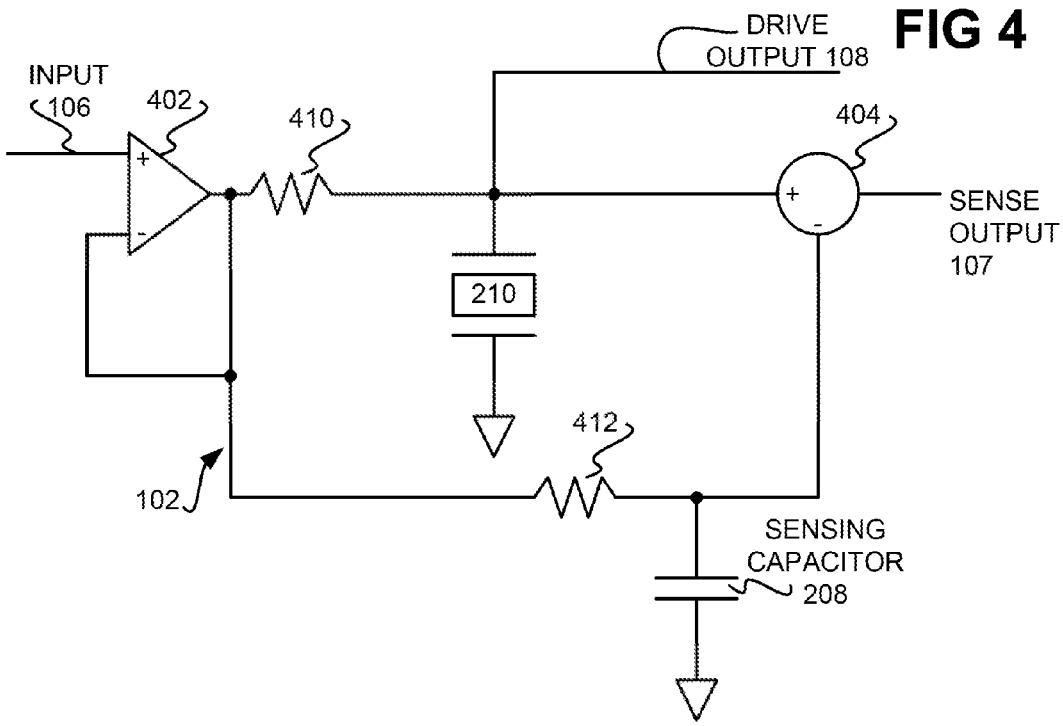
FIG. 4 is a diagram of a drive and sense circuit of the control circuit of FIG. 1 in detail, according to another example.

FIG. 4 shows the drive and sense circuit 102 of FIG. 1 in detail, according to another example of the disclosure. The drive and sense circuit 102 includes an amplifier 402, a summing device 404, resistors 410 and 412, and the sensing capacitor 208. The capacitance of the piezoelectric fluid-ejection mechanism is represented as the capacitance 210, which is connected between the drive output 108 and a common voltage like ground. The example of FIG. 4 includes two resistors 410 and 412, which while increasing power consumption within the drive and sense circuit 102, can be less expensive to fabricate within an integrated circuit than capacitors are. As such, the resistors 410 and 412 minimize the number of capacitors to one, the sensing capacitor 208, in FIG. 4. The sensing capacitor 208 is not scaled in FIG. 4 as it is in FIG. 2 as described above.

The amplifier 402 may be an operational amplifier in one example. The summing device 404 may be constructed from resistors and an operational amplifier in one example. The positive input of the amplifier 402 is the input 106 of the drive and sense circuit 102. The output of the amplifier 402 is connected to the negative input of the amplifier 402. The resistor 410 is connected between the output of the amplifier 402 and the capacitance 210 of the piezoelectric fluid-ejection mechanism. The resistor 412 is connected between the negative input of the summing device 404 and the negative input of the amplifier 402. The sensing capacitor 208 is connected between the resistor 412 and the common voltage. The summing device 404 amplifies the voltage difference between its positive and negative inputs.

The resistors 410 and 412 serve as the top half of an impedance bridge circuit. The capacitance 210 of the piezoelectric fluid-ejection mechanism and the sensing capacitor 208 form the bottom half of the impedance bridge circuit. The amplifier 402 drives the top half of the bridge circuit, and the difference in potential between each side of the bridge circuit is determined by the summing device 404. In this way, the amplifier 402 can drive power to actuate the piezoelectric fluid-ejection mechanism, and at the same the output of the summing device 404 can be used to detect movement (i.e., resonance) within the piezoelectric fluid-ejection mechanism. Furthermore, the resistors 410 and 412 can be scaled to one another in a given ratio to permit the sensing capacitor 208 to have a small capacitance (proportional to the scaling of the resistor 412 to the resistor 410), and thus occupy less physical space when implemented on an integrated circuit and be less expensive to fabricate, than if the resistors 410 and 412 were in a one-to-one ratio.

The summing device 404 amplifies the voltage difference between positive and negative inputs. Because the negative input is connected to the sensing capacitor 208 and the positive input is connected to the capacitance 210 of the piezoelectric fluid-ejection mechanism, the summing device 404 subtracts the voltage over the sensing capacitor 208 from the voltage over the capacitance 210. The output of the amplifier 402, after passing through the resistor 410, is the drive output 108 of the drive and sense circuit 102 as a whole. As such, the output of the amplifier 402 serves to drive the piezoelectric fluid-ejection mechanism to either cause the fluid-ejection mechanism to eject a drop of fluid in the feed-forward driving mode or to be dampened in the feedback damping mode.

In the feed-forward driving mode, the drive output 108 is not fed back through the compensation circuit 103 of FIG. 1 to the input 106 of the drive and sense circuit 102, but rather a drive waveform is applied at the input 106. The drive waveform is amplified by the amplifier 402, to cause the piezoelectric fluid-ejection mechanism at the drive output 108 of the drive and sense circuit to eject a drop of fluid. By comparison, in the feedback damping mode, the drive output 108 is fed back through the compensation circuit 103 of FIG. 1 to the input 106 of the drive and sense circuit 102. The voltage over the capacitance 210 of the fluid-ejection mechanism is compared to the voltage on the sensing capacitor 208 to generate a signal at the drive output 108 that is opposite the resonance of the fluid-ejection mechanism. As such, this resonance is dampened.

It is noted that the summing device 404 effectively compares the voltage over the capacitance 210 of the piezoelectric fluid-ejection mechanism with the voltage over the capacitance of the sensing capacitor 208. This is because the latter voltage is subtracted from the former voltage by the summing device 404. The result of this comparison is the sense output 107.

Figure 5:
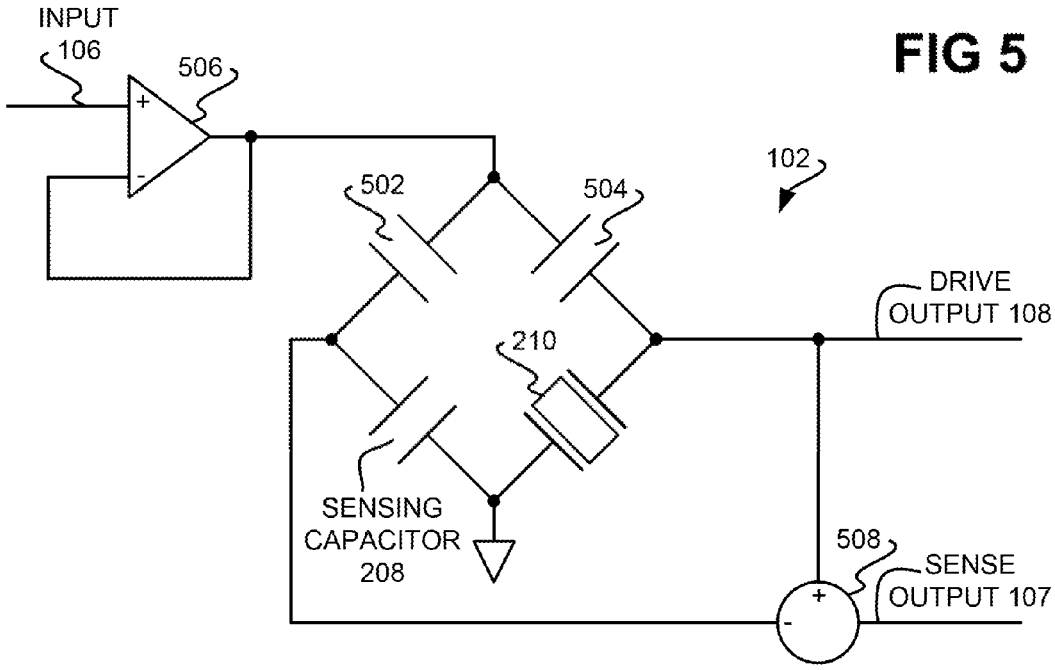
FIG. 5 is a diagram of a drive and sense circuit of the control circuit of FIG. 1 in detail, according to still another example.

FIG. 5 shows the drive and sense circuit 102 of FIG. 1 in detail, according to still another example of the disclosure. The drive and sense circuit 102 of FIG. 5 provides a sense output 107 that is proportional to the position of the piezoelectric actuator within the piezoelectric fluid-ejection mechanism, as compared to the drive and sense circuit 102 of FIGS. 2 and 4, which provide a sense output 107 rate of movement of the piezoelectric actuator. The drive and sense circuit 102 includes capacitors 502 and 504, as well as the sensing capacitor 208, which with the capacitance 210 of the piezoelectric fluid-ejection mechanism are arranged as a bridge circuit. The drive and sense circuit 102 further includes an amplifier 506, such as an operational amplifier.

The positive input of the summing device 508 is connected between the capacitor 504 and the capacitance 210 of the piezoelectric fluid-ejection mechanism, whereas the negative input of the summing device 508 is connected between the capacitor 502 and the sensing capacitor 208. The output of the summing device 508 is the sense output 107. A common voltage, such as ground, is connected between the sensing capacitor 208 and the capacitance 210 of the fluid-ejection mechanism.

The capacitances of the capacitors 502 and 504 are related to one another by a predetermined ratio, which can be 1:1, in which case the capacitances are equal to one another. The capacitance of and the charge on the sensing capacitor 208 in FIG. 5 is related to the capacitance 210 of and the charge on the piezoelectric fluid-ejection mechanism when the fluid-ejection mechanism is unperturbed by a drive waveform and is not resonating (i.e., when the mechanism is at rest), by this same predetermined ratio. Therefore, when the fluid-ejection mechanism is at rest, the voltage at the negative input of the amplifier 506 is equal to the voltage at the positive input of the amplifier 506, and the output of the amplifier 506 is zero, excluding nominal effects from manufacturing and other imperfections within the drive and sense circuit 102.

In the feed-forward driving mode, a drive waveform is input between the capacitors 502 and 504. Since the charge on and the capacitance of the sensing capacitor 208 are fixed, and the charge on and the capacitance 210 of the piezoelectric fluid-ejection mechanism are not, the voltage at the positive input of the amplifier 506 can be greater than or less than the voltage at the negative input of the amplifier 506. This results in the drive waveform asserted at the input 106 and amplified by the amplifier 506 being replicated at the drive output 108. As such, the piezoelectric fluid-ejection mechanism ejects a drop of fluid.

By comparison, in the feedback damping mode, the sense output 107 is fed back to the input 106 of the drive and sense circuit 102 through the compensation circuit 103 of FIG. 1. The capacitance 210 of the piezoelectric fluid-ejection mechanism is measured against the capacitance of the sensing capacitor 208, and a corresponding voltage difference is generated at the input 106, which is amplified by the amplifier 506 at the drive output 108 to counter the resonance of the fluid-ejection mechanism. The generated signal at the drive output 108 is opposite to the resonance of the fluid-ejection mechanism, and in this way, the resonance is dampened.

It is noted that the summing device 508 effectively compares the voltage over the capacitance 210 of the piezoelectric fluid-ejection mechanism with the voltage over the capacitance of the sensing capacitor 208. This is because the latter voltage is subtracted from the former voltage by the summing device 508. The result of this comparison is the sense output 107.

Figure 6:
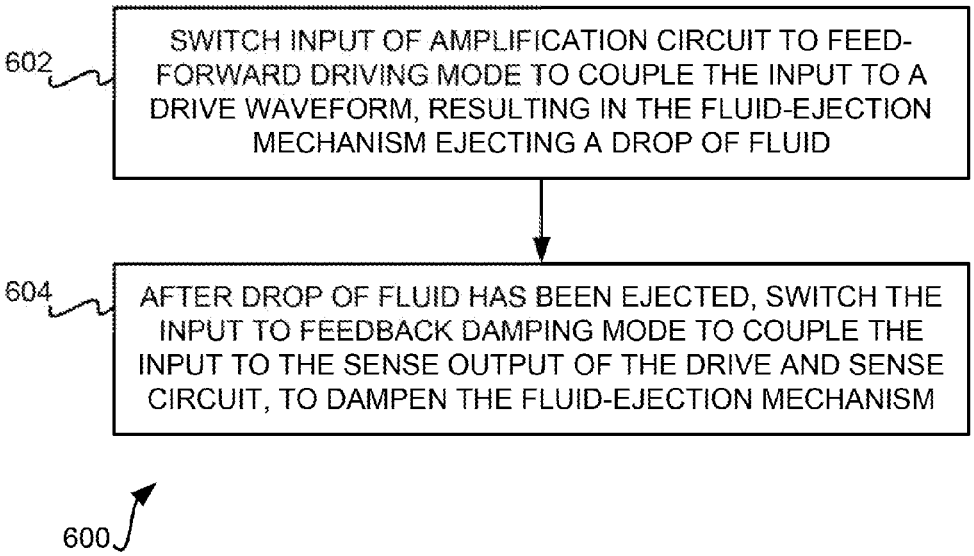
FIG. 6 is a flowchart of an example method for using the control circuit of FIG. 1.

FIG. 6 shows a method 600 for using the control circuit 100 of FIG. 1, according to an example. The method 600 may be implemented as one or more computer programs stored on a computer-readable data storage medium. The computer programs are by a processor or another type of integrated circuit, such as an application-specific integrated circuit (ASIC).

To cause the piezoelectric fluid-ejection mechanism to eject a fluid drop, the switch 104 couples the input 106 of the drive and sense circuit 102 to the drive waveform 110 (602). As such, the drive and sense circuit 102 is operating in a feed-forwarding driving mode. The drive waveform 110, which corresponds to a desired drop of fluid to be ejected from the fluid-ejection mechanism, thus results in the mechanism ejecting such a fluid drop.

After the fluid-ejection mechanism has ejected the drop of fluid, the switch 104 couples the input 106 to the sense output 107 of the drive and sense circuit 102 (604), as compensated by the compensation circuit 109 as the compensated sense output 109. As such, the drive and sense circuit 102 is operating in a feedback damping mode. This results in a signal being generated at the drive output 108 of the drive and sense circuit 102 that opposes the resonance of the piezoelectric fluid-ejection mechanism, and which quickly dampens the resonance of the fluid-ejection mechanism.

Figure 7:
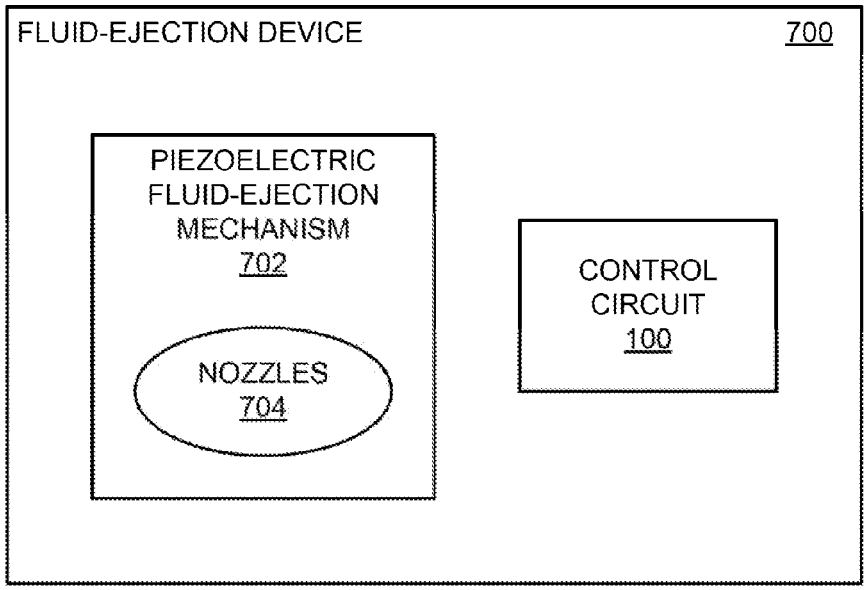
FIG. 7 is a block diagram of an example rudimentary drop-on-demand piezoelectric fluid-ejection mechanism that includes the control circuit of FIG. 1.

FIG. 7 shows a rudimentary drop-on-demand piezoelectric fluid-ejection device 700, according to an example. The fluid-ejection device 700 may be a printer, another type of printing device, or another type of fluid-ejection device. An example of a printing device other than a printer is a multifunction device (MFD) or an all-in-one (AIO) device, which has functionality such as scanning and/or faxing in addition to printing functionality.

The fluid-ejection device 700 includes a piezoelectric fluid-ejection mechanism 702 and the control circuit 100 that has been described. The fluid-ejection mechanism 702 includes a number of fluid-ejection nozzles 704 from which fluid is actually ejected. The fluid-ejection mechanism 702 can be a part of a fluid-ejection printhead, may include one or more fluid-ejection printheads, or may be a fluid-ejection printhead. The control circuit 100 may be part of such a fluid-ejection printhead, or the control circuit 100 may be external to the printhead.

It is noted that the fluid-ejection device 700 may be an inkjet-printing device, which is a device, such as a printer, that ejects ink onto media, such as paper, to form images, which can include text, on the media. The fluid-ejection device 700 is more generally a fluid-ejection precision-dispensing device that precisely dispenses fluid, such as ink. The fluid-ejection device 700 may eject pigment-based ink, dye-based ink, another type of ink, or another type of fluid. Examples of other types of fluid include those having water-based or aqueous solvents, as well as those having non-water-based or non-aqueous solvents. Examples disclosed herein can thus pertain to any type of fluid-ejection precision-dispensing device that dispenses a substantially liquid fluid.

A fluid-ejection precision-dispensing device is therefore a drop-on-demand device in which printing, or dispensing, of the substantially liquid fluid in question is achieved by precisely printing or dispensing in accurately specified locations, with or without making a particular image on that which is being printed or dispensed on. The fluid-ejection precision-dispensing device precisely prints or dispenses a substantially liquid fluid in that the latter is not substantially or primarily composed of gases such as air. Examples of such substantially liquid fluids include inks in the case of inkjet-printing devices. Other examples of substantially liquid fluids thus include drugs, cellular products, organisms, fuel, and so on, which are not substantially or primarily composed of gases such as air and other types of gases, as can be appreciated by those of ordinary skill within the art.

I claim:

1. A control circuit for a drop-on-demand piezoelectric fluid-ejection mechanism, comprising:

a drive and sense circuit comprising a sensing capacitor and having an input, a drive output, and a sense output, the drive output to be coupled to the drop-on-demand piezoelectric fluid-ejection mechanism; and, a switch to switch the input of the drive and sense circuit between a feed-forward driving mode of the drive and sense circuit and a feedback damping mode of the drive and sense circuit, wherein the drive and sense circuit is to compare a voltage over a capacitance of the sensing capacitor to a voltage over a capacitance of the fluid-ejection mechanism, wherein in the feed-forward driving mode, the switch is to couple the input to a drive waveform to cause the fluid-ejection mechanism to eject a drop of fluid, and wherein in the feedback damping mode, the switch is to couple the input to the sense output to dampen the fluid-ejection mechanism after the fluid-ejection mechanism has ejected the drop of fluid.

2. The control circuit of claim 1, further comprising a compensation circuit to compensate the sense output before the sense output is coupled to the input in the feedback damping mode.

3. The control circuit of claim 1, wherein the drive and sense circuit is resistorless, and further comprises a current mirror.

4. The control circuit of claim 3, wherein the drive and sense circuit further comprises:

an amplifier positioned between the input of the drive and sense circuit and the current mirror; and, a summing device positioned between the current mirror and the sense output of the drive and sense circuit, wherein the sensing capacitor is connected at a point between the current mirror and the summing device, wherein the capacitance of the fluid-ejection mechanism is connected at the drive output of the drive and sense circuit, and wherein the current mirror is to effectively reduce the current output by the amplifier.

5. The control circuit of claim 4, wherein a positive input of the amplifier is the input of the drive and sense circuit, wherein one or more first outputs of the amplifier are connected to one or more inputs of the current mirror, wherein a first output of the current mirror is the drive output of the drive and sense circuit, is directly connected to a positive input of the summing device, and is indirectly connected to a negative input of the amplifier, wherein a second output of the current mirror is connected to a negative input of the summing device, and an output of the summing device is the sense output of the drive and sense circuit.

6. The control circuit of claim 3, wherein the current mirror comprises one or more switchable trimming stages to decrease a current of the drive and sense circuit at an output of the circuit mirror when no signal is being applied at the input of the drive and sense circuit.

7. The control circuit of claim 1, wherein the drive and sense circuit comprises one or more resistors, an amplifier, and a summing device.

8. The control circuit of claim 7, wherein a positive input of the amplifier is the input of the drive and sense circuit, and a negative input of the amplifier is connected to an output of the amplifier, wherein the resistors comprise a first resistor and a second resistor, wherein the first resistor is connected between the output of the amplifier and a positive input of the summing device, wherein the second resistor is connected between the output of the amplifier and a negative input of the summing device, wherein the capacitance of the fluid-ejection mechanism is connected to the positive input of the summing device, and the sensing capacitor is connected to the negative input of the summing device, and wherein the drive output is at the positive input of the summing device, and the sense output is an output of the summing device.

9. The control circuit of claim 1, wherein the drive and sense circuit comprises:

a first capacitor and a second capacitor in addition to the sensing capacitor, where the first capacitor, the second capacitor, the sensing capacitor, and the capacitance of the fluid-ejection mechanism are arranged as a bridge circuit.

10. A fluid-ejection device comprising:

a drop-on-demand piezoelectric fluid-ejection mechanism; and, a control circuit for the fluid-ejection mechanism, comprising:

a drive and sense circuit comprising a sensing capacitor and having an input, a drive output, and a sense output, the drive output to be coupled to the drop-on-demand piezoelectric fluid-ejection mechanism; and, a switch to switch the input of the drive and sense circuit between a feed-forward driving mode of the drive and sense circuit and a feedback damping mode of the drive and sense circuit, wherein the drive and sense circuit is to compare a voltage over a capacitance of the sensing capacitor to a voltage over a capacitance of the fluid-ejection mechanism, wherein in the feed-forward driving mode, the switch is to couple the input to a drive waveform to cause the fluid-ejection mechanism to eject a drop of fluid, and wherein in the feedback damping mode, the switch is to couple the input to the sense output to dampen the fluid-ejection mechanism after the fluid-ejection mechanism has ejected the drop of fluid.

11. The fluid-ejection device of claim 10, wherein the drive and sense circuit is resistorless and further comprises:

a current mirror;

an amplifier positioned between the input of the drive and sense circuit and the current mirror; and, a summing device positioned between the current mirror and the sense output of the drive and sense circuit, wherein the sensing capacitor is connected at a point between the current mirror and the summing device, wherein the capacitance of the fluid-ejection mechanism is connected at the drive output of the drive and sense circuit, and wherein the current mirror is to effectively reduce the current output by the amplifier.

12. The fluid-ejection device of claim 11, wherein a positive input of the amplifier is the input of the drive and sense circuit, wherein one or more first outputs of the amplifier are connected to one or more inputs of the current mirror, wherein a first output of the current mirror is the drive output of the drive and sense circuit, is directly connected to a positive input of the summing device, and is indirectly connected to a negative input of the amplifier, wherein a second output of the current mirror is connected to a negative input of the summing device, and an output of the summing device is the sense output of the drive and sense circuit.

13. A method comprising:

to cause a drop-on-demand piezoelectric fluid-ejection mechanism to eject a drop of fluid, switching an input of a drive and sense circuit of a control circuit for the fluid-ejection mechanism to a feed-forward driving mode to couple the input to a drive waveform corresponding to the drop of fluid to be ejected by the fluid-ejection mechanism, the drive and sensing circuit having a sensing capacitor; and, after the fluid-ejection mechanism has ejected the drop of fluid, switching the input of the drive and sense circuit to a feedback damping mode to couple the input to a sense output of the drive and sense circuit to dampen the fluid-ejection mechanism, by the drive and sense circuit comparing a voltage over a capacitance of the sensor capacitor to a voltage over a capacitance of the fluid-ejection mechanism.

* * * * *

UNITED STATES PATENT AND TRADEMARK OFFICE

CERTIFICATE OF CORRECTION

PATENT NO. : 8,864,280 B2
APPLICATION NO. : 13/696974
DATED : October 21, 2014
INVENTOR(S) : Andrew L. Van Brocklin It is certified that error appears in the above-identified patent and that said Letters Patent is hereby corrected as shown below:

On the Title page, in item (73), Assignee, in column 1, line 2, delete "Company," and insert -- Company, L.P., --, therefor.

Signed and Sealed this
Seventh Day of April, 2015

Michelle K. Lee

Michelle K. Lee
*Director of the United States Patent and Trademark Office*